US005456053A

United States Patent [19]

Fischer

[11] Patent Number: 5,456,053

[45] Date of Patent: Oct. 10, 1995

[54] FLOORING INSTALLATION APPARATUS

[76] Inventor: Kenneth A. Fischer, 2689 E. Verne Rd., Burt, Mich. 48417

[21] Appl. No.: 100,258

[22] Filed: Aug. 2, 1993

[51] Int. Cl.[6] ..... E04D 15/00

[52] U.S. Cl. ..... 52/749.1; 254/15; 254/16; 254/113

[58] Field of Search ..... 254/15–17, 113, 254/124, 120; 52/749

[56] References Cited

U.S. PATENT DOCUMENTS

| | | | |
|---|---|---|---|
| 1,911,705 | 5/1933 | McMullan | 254/15 |
| 4,531,716 | 7/1985 | Rish | 254/21 |
| 4,621,791 | 11/1986 | Staskiewicz | 254/17 |
| 4,846,443 | 7/1989 | Collins | 254/8 B |
| 5,139,231 | 8/1992 | Temple | 254/15 |
| 5,181,694 | 1/1993 | Collins | 254/8 B |
| 5,248,127 | 9/1993 | Young | 254/15 |

*Primary Examiner*—Carl D. Friedman
*Assistant Examiner*—Beth A. Aubrey

[57] ABSTRACT

A new and improved flooring installation apparatus includes a clamping assembly for clamping onto a rigid structure below a floor board to be installed. The clamping assembly is capable of clamping onto the rigid structure at a bottom edge of the rigid structure. A handle assembly is pivotally attached to the clamping assembly. The handle assembly includes a pivoting portion for pivotally attaching to the clamping assembly. The handle assembly includes a lever arm portion connected to the pivoting portion. The handle assembly includes a handle grip connected to the lever arm portion. A board pusher assembly is connected to the lever arm portion of the handle assembly, such that, when the clamping assembly is clamped onto a rigid structure, and when a force is exerted on the handle grip in a direction toward a floor board, the board pusher assembly is capable of pushing against the floor board. A ratcheting assembly in conjunction with a pawl assembly locks the handle assembly into a force-exerting position when the lever arm portion is pushing against the board pusher assembly. A disengaging assembly is provided for disengaging the pawl assembly from the ratchet teeth assembly. A mechanized nail driving machine may also be provided. A support assembly attaches the mechanized nail driving machine to the ram member. A nailing machine actuator is attached to the lever arm portion in the vicinity of the handle grip.

20 Claims, 4 Drawing Sheets

FIG. 6
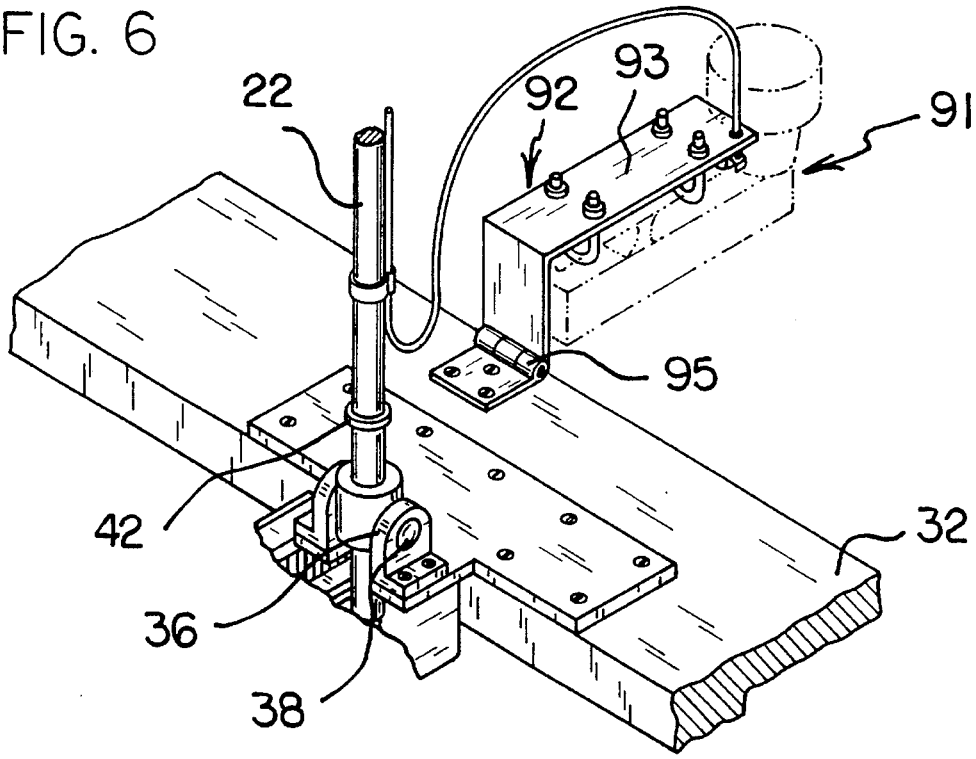
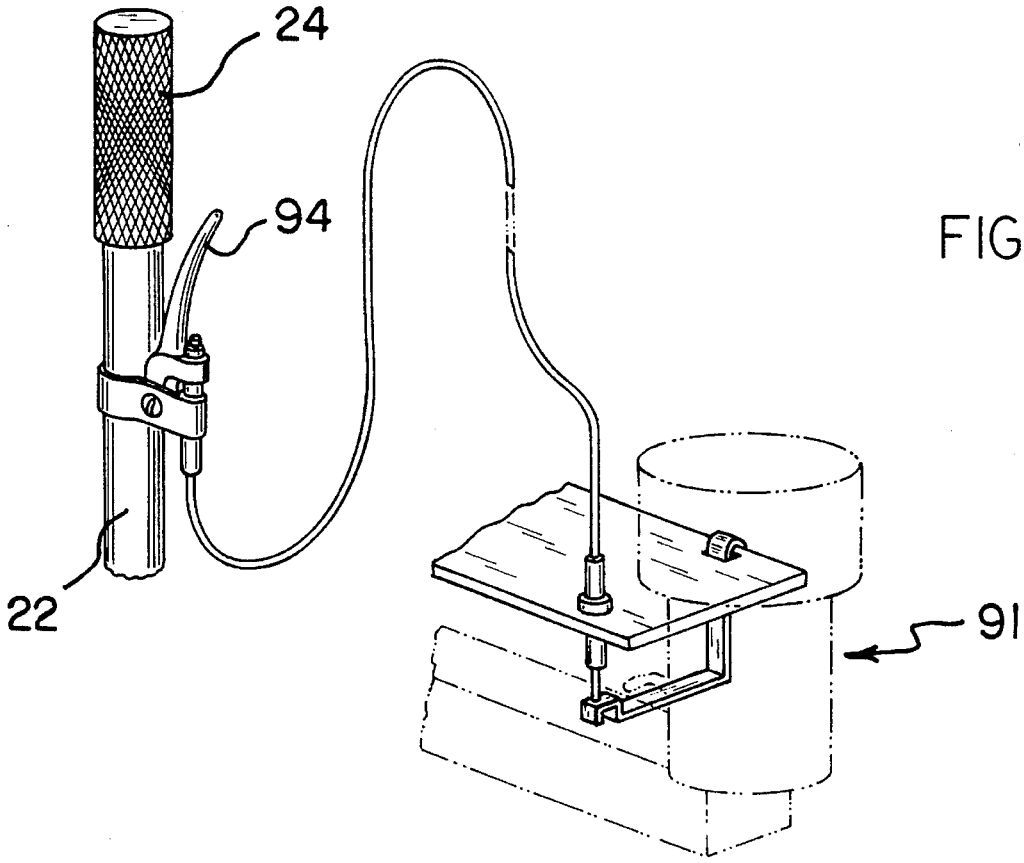
FIG. 7

FLOORING INSTALLATION APPARATUS

BACKGROUND OF THE INVENTION

1. Field of the Invention

The present invention relates generally to devices for installing floor boards, and, more particularly, to a device especially adapted for assuring a tight fit between complementary tongue and groove structures of floor boards.

2. Description of the Prior Art

Floor boards are often joined together by a tongue-in-groove connection. Ideally, the tongues would fit into the grooves with ease and a perfect fit. In reality, however, the tongues are not perfectly complementary with the grooves. Therefore, to properly install the respective tongues in the respective grooves, some kind of force must be applied. Often, a worker uses a hammer or a mallet to force the respective tongues into the respective grooves. The use of a hammer or a mallet has several possible undesirable consequences. First, the hammering action can dent or otherwise damage the floor boards. Second, without a highly skilled user, a hammer often misses the exact spot on the object that it is being swung to hit. Third, the use of a hammer creates quite a bit of noise. In view of these problems associated with hammering floor boards into position, it would be desirable if a device were provided that permits proper installation of tongue-in-groove floor boards without hammering.

Hammering may do damage to the edges of floor boards because so much force is concentrated in a small surface area, the hammer head. In this respect it would be desirable if a floor board installation device were provided which applied an installation force over a relatively large surface area to avoid damaging the floor boards during installation.

A hammer can wield a large force because of a build up of kinetic energy as the hammer is swung. If a hammer is not used, some other source of energy must be substituted in its place. Because a swinging hammer moves so fast, it is very hard to control. In this respect it would be desirable if a floor board installation device were provided that did not rely upon a rapidly moving, hard to control element for exerting force against a floor board for installation into an adjacent floor board.

Besides a swinging hammer, there are other principles for multiplying force. Hydraulics and pulleys are often used for multiplying forces. Levers are also used for multiplying force. Hydraulic systems usually require heavy apparatus that can withstand very large hydraulic pressures. Pulleys require cables or chains that can become tangled. Therefore, a leverage system would be preferred among the three force multiplying systems. In this respect it would be desirable if a floor board installation device were provided which employs levers for installing tongue-in-groove floor boards.

To install tongue-in-groove floor boards, two primary sources of resistive forces to installation are the inertia of the floor boards and the frictional forces between the respective tongues and grooves. When a hammer strikes the side of a floor board, much of the kinetic energy of the hammer strike is absorbed by the floor board to overcome the inertia of the floor board. Much less of the kinetic energy goes toward forcing the tongue into the groove. This is the primary reason why floor boards can be damaged when hammered; the energy absorbed by the floor board damages the floor board. To avoid this type of damage to floor boards during installation, it would be desirable if a floor board installation device were provided that does not apply large amounts of kinetic energy to floor boards that can cause damage to the floor boards.

It is the sharp, high impact of hammer blow that can damage the tongue-in-groove floor boards. In this respect it would be desirable if a floor board installation device were provided that applied a slowly building force to the floor board rather than a sharp blow.

Still other features would be desirable in a flooring installation apparatus. Once a slowly building force is applied to the floor board, it would be desirable if the built-up force could be sustained and continuously applied for a period of time rather than dissipate immediately as occurs with a hammer blow. Once a floor board has been properly installed, the installation apparatus must be moved out of the way to make room for installing the next floor board. In this respect it would be desirable if a floor board installation device were provided that is easily removed from one floor board to be applied to the next floor board needing installation.

The operation of installing a tongue-in-groove floor board is often intimately associated with the subsequent operation of nailing the installed floor board into position on the floor. In this respect it would be desirable if a floor board installation device were provided that included a mechanized device for nailing the floor board into position on the floor once the tongue-in-groove installation has been made.

Throughout the years, a number of innovations have been developed relating to devices using simple levers for multiplying force, and the following U.S. patents are representative of some of those innovations: Nos. 4,042,210; 4,625,945; 4,785,488; 5,010,791; and Des. No. 301,301. None of these prior art simple lever devices are disclosed as being suitable for installing tongue-in-groove floor boards. In this respect it would be desirable if a floor board installation device were provided that employs a simple lever for installing a tongue-in-groove floor board.

Thus, while the foregoing body of prior art indicates it to be well known to use hammering devices to install tongue-in-groove floor boards, the prior art described above does not teach or suggest a flooring installation apparatus which has the following combination of desirable features: (1) permits proper installation of tongue-in-groove floor boards without hammering; (2) applies an installation force over a relatively large surface area to avoid damaging the floor boards during installation; (3) does not rely upon a rapidly moving, hard to control element for exerting force against a floor board for installation into an adjacent floor board; (4) employs levers for installing tongue-in-groove floor boards; (5) does not apply large amounts of kinetic energy to floor boards that can cause damage to the floor boards; (6) applies a slowly building force to the floor board rather than a sharp blow; (7) sustains and continuously applies a built-up force on a tongue-in-groove floor board for a period of time rather than dissipate a force immediately as occurs with a hammer blow; (8) is easily removed from one floor board to be applied to the next floor board needing installation; (9) includes a mechanized device for nailing the floor board into position on the floor once the tongue-in-groove installation has been made; and (10) employs a simple lever for installing a tongue-in-groove floor board. The foregoing desired characteristics are provided by the unique flooring installation apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved flooring installation apparatus which includes a clamping assembly for clamping onto a rigid structure below a floor board to be installed. The clamping assembly is capable of clamping onto the rigid structure at a bottom edge of the rigid structure. A handle assembly is pivotally attached to the clamping assembly. The handle assembly includes a pivoting portion for pivotally attaching to the clamping assembly. The handle assembly includes a lever arm portion connected to the pivoting portion. The handle assembly includes a handle grip connected to the lever arm portion. A board pusher assembly is connected to the lever arm portion of the handle assembly, such that, when the clamping assembly is clamped onto a rigid structure, and when a force is exerted on the handle grip in a direction toward a floor board, the board pusher assembly is capable of pushing against the floor board.

More specifically, the board pusher assembly may include a ram assembly. A connector assembly is connected to the ram assembly, for connecting the board pusher assembly to the handle assembly. The connector assembly includes a first pivoted joint element connected to the ram assembly. A second pivoted joint element connects to the first pivoted joint element. The second pivoted joint element is located on a handle connecting element which is connected to the handle assembly. The handle connecting element of the connector assembly is capable of being adjusted along a length of the lever arm portion of the handle assembly.

The handle connecting element is in the form of a sleeve that is capable of sliding up and down the lever arm portion. A stop element, located on the lever arm portion, is used for limiting longitudinal motion of the connector assembly along the lever arm portion.

The clamping assembly may include a pair of jaw assemblies in which spring-biased assemblies are connected to the jaw assemblies and are capable of urging the jaw assemblies apart to be retracted away from the rigid structure. A carrier assembly is connected to the spring-biased assemblies. The carrier assembly also includes a pivot post for connection to the handle assembly, wherein by control executed through the handle assembly, through the carrier assembly, and through the spring-biased assemblies, the pair of jaw assemblies are capable of being selectively clamped onto the rigid structure for exerting a clamping force thereon or are capable of being retracted from the rigid structure.

The respective clamping force and the respective retracting force of the jaw assemblies are controlled by operation of the handle assembly. The jaw assemblies include clamping pad elements and respective clamping pad support brackets for receiving and supporting the clamping pad elements. The clamping pad elements include tabs that engage complementary slots in the respective clamping pad support brackets. The respective clamping pad support brackets are supported by the spring-biased assemblies.

The respective spring-biased assemblies include a first link element and a second link element. The first and second link elements are pivotally connected together at respective first ends to a first hinge pin which is connected to the carrier assembly at a receiving aperture. A second end of the first link element is connected to a first support bracket by a second hinge pin. A second end of the second link element is connected to a second support bracket by a third hinge pin.

The clamping pad elements include an upper chamfered edge. The clamping pad elements include roughened inner walls which permit the clamping pad elements to bite into sides of the rigid structure.

A ratcheting assembly locks the handle assembly into a force-exerting position when the lever arm portion is pushing against the board pusher assembly. The ratcheting assembly includes a ratchet teeth assembly rigidly attached to the clamping assembly. A pivoted pawl assembly is connected to the handle assembly, such that, when the pivoted pawl assembly engages the ratchet teeth assembly, the handle assembly is locked into a force-exerting position for exerting a force on the board pusher assembly.

The pivoted pawl assembly includes a pawl element for directly engaging ratchet teeth of the ratchet teeth assembly. A shaft is connected to the pawl element. A housing received the shaft. The housing is supported by the handle assembly, and a shaft biasing assembly is connected to the shaft for biasing the shaft such that the pawl element normally engages teeth of the ratchet teeth assembly.

The shaft biasing assembly includes a lever element connected to the shaft. A spring is connected to the lever element. A spring support element is connected to the handle assembly, for biasing the spring with respect to the lever element such that the shaft is biased and causes the shaft to urge the pawl element into engagement with the ratchet teeth of the ratchet teeth assembly.

A disengaging assembly is provided for disengaging the pawl assembly from the ratchet teeth assembly. The disengaging assembly includes a trip lever connected to the lever element. A selectable actuator assembly is connected to the handle assembly, for selectively actuating the trip lever. The selectable actuator assembly includes an actuator element for actuating the trip lever, and a handle sleeve which fits over the lever arm portion of the handle assembly. The handle sleeve is rotatable on the lever arm portion. The lever arm portion supports the actuator element.

A mechanized nail driving machine is provided. A support assembly attaches the mechanized nail driving machine to the ram member. A nailing machine actuator is attached to the lever arm portion in the vicinity of the handle grip.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved flooring installation apparatus which has all of the advantages of the prior art and none of the disadvantages.

It is another object of the present invention to provide a new and improved flooring installation apparatus which may be easily and efficiently manufactured and marketed.

It is a further object of the present invention to provide a new and improved flooring installation apparatus which is of durable and reliable construction.

An even further object of the present invention is to provide a new and improved flooring installation apparatus which is susceptible of a low cost of manufacture with regard to both materials and labor, and which accordingly is then susceptible of low prices of sale to the consuming public, thereby making such flooring installation apparatus available to the buying public.

Still yet a further object of the present invention is to provide a new and improved flooring installation apparatus which permits proper installation of tongue-in-groove floor boards without hammering.

Still another object of the present invention is to provide a new and improved flooring installation apparatus that applies an installation force over a relatively large surface area to avoid damaging the floor boards during installation.

Yet another object of the present invention is to provide a new and improved flooring installation apparatus which does not rely upon a rapidly moving, hard to control element for exerting force against a floor board for installation into an adjacent floor board.

Even another object of the present invention is to provide a new and improved flooring installation apparatus that employs levers for installing tongue-in-groove floor boards.

Still a further object of the present invention is to provide a new and improved flooring installation apparatus which does not apply large amounts of kinetic energy to floor boards that can cause damage to the floor boards.

Yet another object of the present invention is to provide a new and improved flooring installation apparatus that applies a slowly building force to the floor board rather than a sharp blow.

Still another object of the present invention is to provide a new and improved flooring installation apparatus which sustains and continuously applies a built-up force on a tongue-in-groove floor board for a period of time rather than dissipate a force immediately as occurs with a hammer blow.

Yet another object of the present invention is to provide a new and improved flooring installation apparatus that is easily removed from one floor board to be applied to the next floor board needing installation.

Still a further object of the present invention is to provide a new and improved flooring installation apparatus that includes a mechanized device for nailing the floor board into position on the floor once the tongue-in-groove installation has been made.

Yet another object of the present invention is to provide a new and improved flooring installation apparatus which employs a simple lever for installing a tongue-in-groove floor board.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 6 is a partial perspective view of a third embodiment of the flooring installation apparatus of the invention, wherein a mechanized nail driving device is combined with the device for installing the tongue-in-groove floor boards.

FIG. 7 is a partial perspective view of the embodiment of the invention shown in FIG. 6 showing a trigger for the mechanized nail driving device placed on the manually operated lever of the invention.

DESCRIPTION OF THE PREFERRED EMBODIMENT

Figure 1:
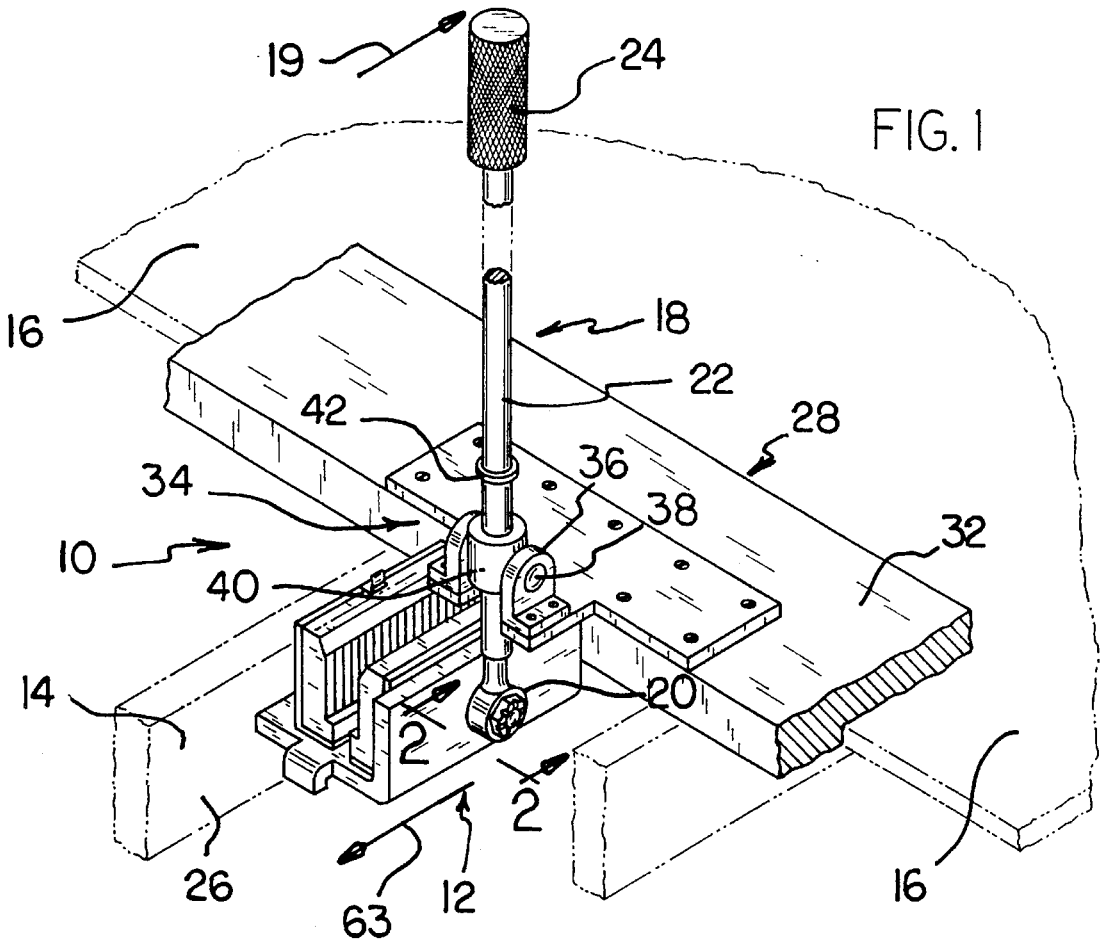
FIG. 1 is a perspective view showing a first preferred embodiment of the flooring installation apparatus of the invention clamped onto an underlying floor joist.
Figure 2:
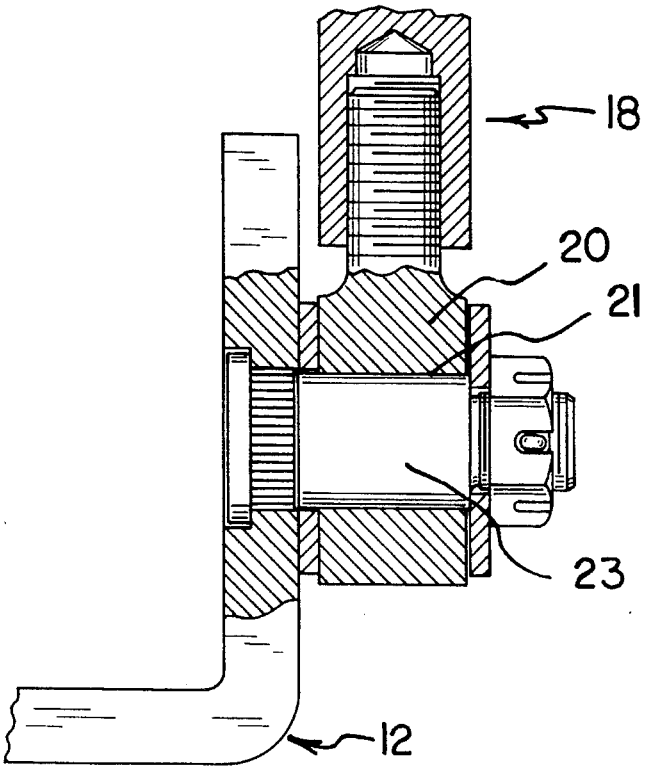
FIG. 2 is an enlarged, partial cross-sectional view of the flooring installation apparatus along line 2—2 of FIG. 1.
Figure 3:
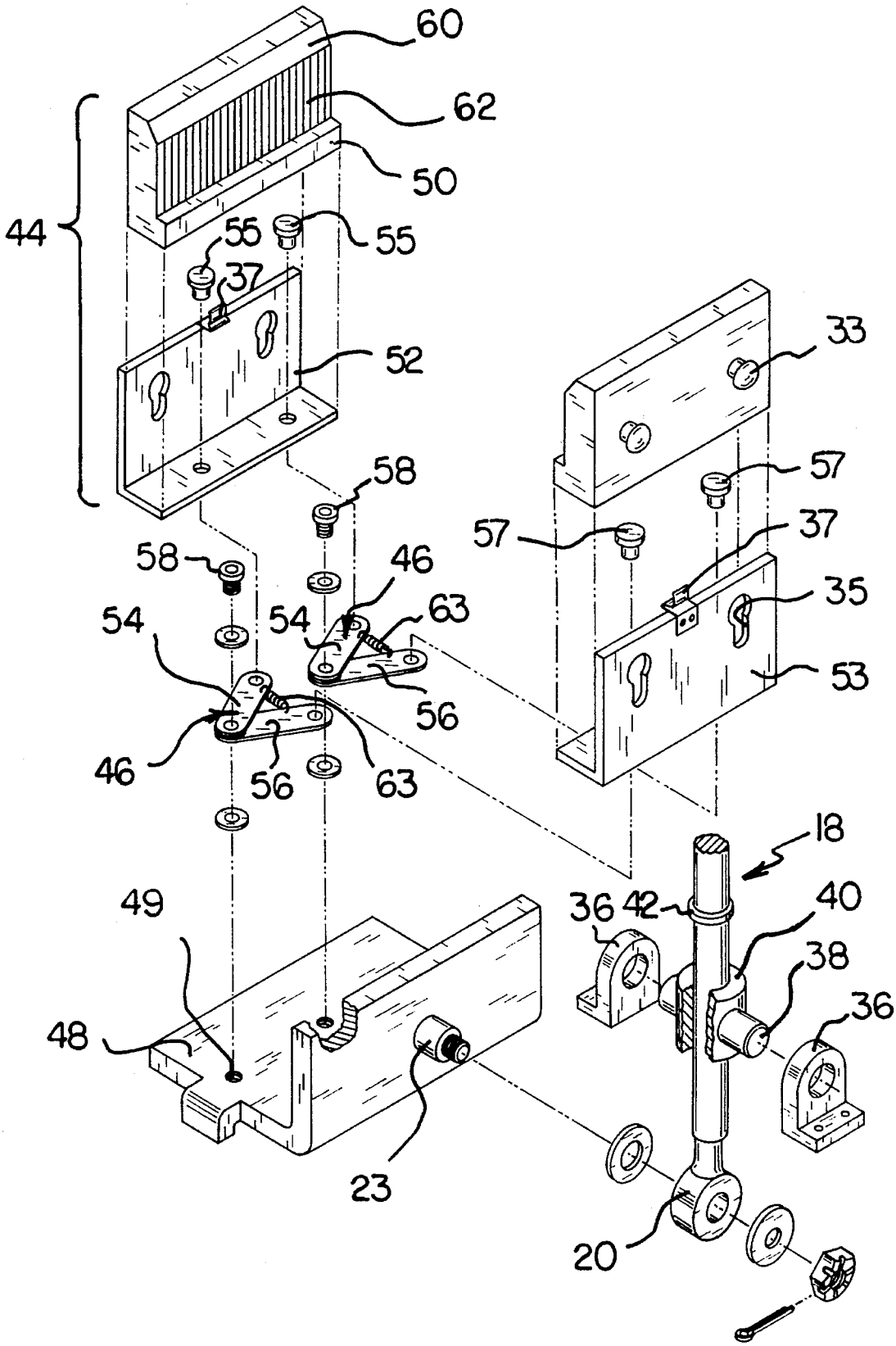
FIG. 3 is an exploded perspective view of the clamping assembly of the embodiment of the invention shown in FIG. 1 used for clamping onto the underlying floor joist.
Figure 4:
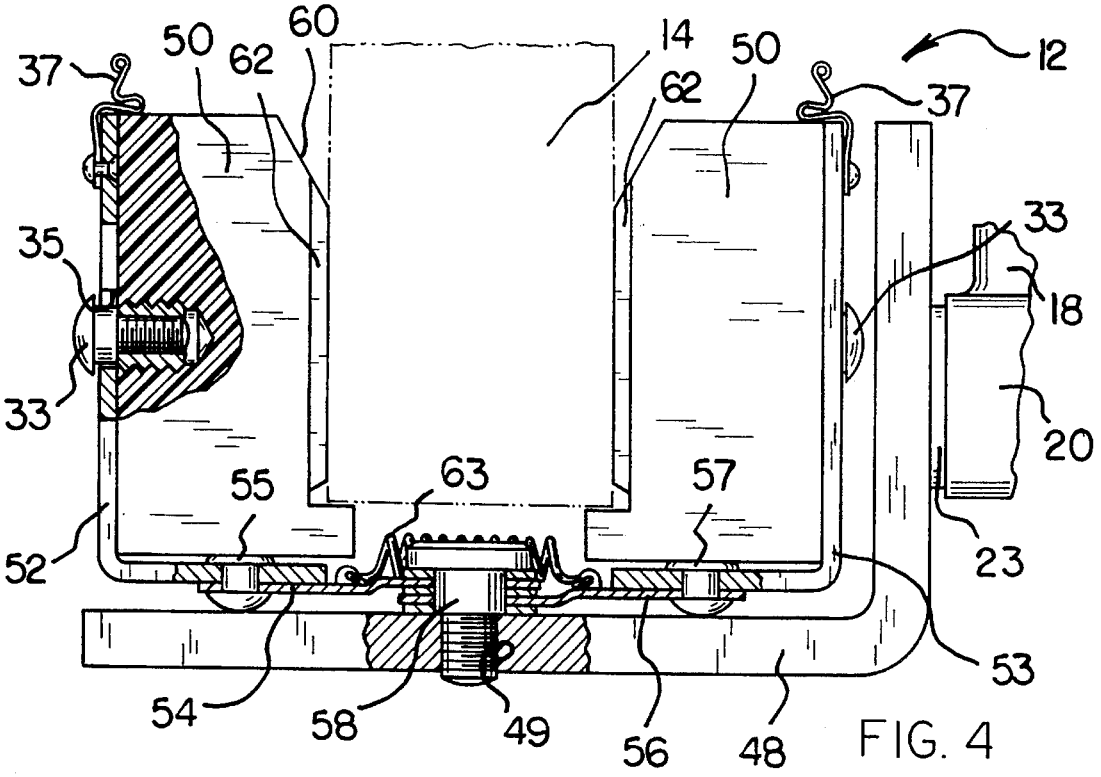
FIG. 4 is an enlarged front view of the clamping assembly shown in FIG. 1.

With reference to the drawings, a new and improved flooring installation apparatus embodying the principles and concepts of the present invention will be described.

Turning initially to FIGS. 1–4, there is shown a first exemplary embodiment of the flooring installation apparatus of the invention generally designated by reference numeral 10. In its preferred form, flooring installation apparatus 10 includes a clamping assembly 12 for clamping onto a rigid structure 14, e.g. a floor joist, below a floor board 16 to be installed. The clamping assembly 12 is capable of clamping onto the rigid structure 14 at a bottom edge 26 of the rigid structure 14. A handle assembly 18 is pivotally attached to the clamping assembly 12. The handle assembly 18 includes a pivoting portion 20 for pivotally attaching to the clamping assembly 12. The handle assembly 18 includes a lever arm portion 22 connected to the pivoting portion 20. The handle assembly 18 includes a handle grip 24 connected to the lever arm portion 22. A board pusher assembly 28 is connected to the lever arm portion 22 of the handle assembly 18, such that, when the clamping assembly 12 is clamped onto a rigid structure 14, and when a force is exerted on the handle grip 24 in a direction toward a floor board 16, as indicated by arrow 19, the board pusher assembly 20 is capable of pushing against the floor board 16.

In operation, by placing the board pusher assembly 28 against a side of a floor board 16, and by pushing or pulling on the hand grip portion 24 in the direction indicated by arrow 19, a lever action is created. The fulcrum is at the pivoting connection 21 between the pivoting portion 20 of the handle assembly 18 and a pivot post 23 on the clamping assembly 12. The leveraged or multiplied force is exerted by the lever arm portion 22 on the board pusher assembly 28 and onto the floor board 16 which is in contact with the board pusher assembly 28. The force multiplication effect is obtained because the first lever arm distance between the hand grip portion 24 and the pivoting portion 20 is greater than the second lever arm distance between the board pusher assembly 28 and the pivoting portion 20. The multiplied force is applied to the tongue-in-groove connection between adjacent floor boards to facilitate the installation thereof. The handle grip 24 can be pushed or pulled with a steadily increasing force. In this way, the floor board 16 is not subjected to a sharp hammering force and is not as susceptible to damage during installation as might occur by using a hammer.

More specifically, the board pusher assembly 28 may include a ram assembly 32. A connector assembly 34 is connected to the ram assembly 32, for connecting the board pusher assembly 28 to the handle assembly 18. The connector assembly 34 includes a first pivoted joint element 36 connected to the ram assembly 32. A second pivoted joint element 38 connects to the first pivoted joint element 36. The second pivoted joint element 38 is located on a handle connecting element 40 which is connected to the handle assembly 18. The handle connecting element 40 of the connector assembly 34 is capable of being adjusted along a length of the lever arm portion 22 of the handle assembly 18.

The handle connecting element 40 is in the form of a sleeve that is capable of sliding up and down the lever arm portion 22. A stop element 42, located on the lever arm portion 22, is used for limiting longitudinal motion of the connector assembly 34 along the lever arm portion 22.

The clamping assembly 12 may include a pair of jaw assemblies 44 in which spring-biased assemblies 46 are connected to the jaw assemblies 44 and are capable of urging the jaw assemblies 44 apart to be retracted away from the rigid structure 14. A carrier assembly 48 is connected to the spring-biased assemblies 46. The carrier assembly 48 also includes a pivot post 23 for connection to the handle assembly 18, wherein by control executed through the handle assembly 18, through the carrier assembly 48, and through the spring-biased assemblies 44, the pair of jaw assemblies 44 are capable of being selectively clamped onto the rigid structure 14 for exerting a clamping force thereon or are capable of being retracted from the rigid structure 14.

The respective clamping force and the respective retracting force of the jaw assemblies 44 is controlled by operation of the handle assembly 18. The jaw assemblies 44 include clamping pad elements 50 and respective clamping pad support brackets 52 for receiving and supporting the clamping pad elements 50. The clamping pad elements 50 include tabs 33 that engage complementary slots 35 in the respective clamping pad support brackets 52. The clamping pad elements 50 can come is a variety of thicknesses to accommodate a variety of thicknesses of floor joists 14. One set of clamping pad elements 50 can easily be slipped off of the support brackets 52 and 53 and replaced with different pad elements 50. Springs 37 are used to secure the pad elements 50 onto the support brackets 52 and 53. The respective clamping pad support brackets 52 are supported by the spring-biased assemblies 46.

The respective spring-biased assemblies 46 include a first link element 54 and a second link element 56. The first and second link elements are pivotally connected together at respective first ends to a first hinge pin 58 which is connected to tho carrier assembly 48 at a receiving aperture 49. A second end of the first link element 54 is connected to a first support bracket 52 by a second hinge pin 55. A second end of the second link element 56 is connected to a second support bracket 53 by a third hinge pin 57.

The clamping pad elements 50 include an upper chamfered edge 60. The chamfered edge 60 permits the clamping pad elements 50 to be easily slipped onto a rigid structure 14 such as the floor joist 14. The clamping pad elements 50 include roughened inner walls 62 which permit the clamping pad elements 50 to bite into sides of the rigid structure 14.

More specifically with respect to the operation of the embodiment of the invention shown in FIGS. 1–4, the clamping assembly 12 is installed onto the floor joist 14 by lifting the clamping 12 assembly from below the floor joist 14 and having the floor joist 14 become wedged between the clamping pad elements 50. Springs 63 urge the respective links 54 and 56 together, whereby the teeth 62 which are present on the roughened inner walls of the pad elements 50 grip the side surfaces of the floor joist 14.

After the pad elements 50 are in position gripping the side surfaces of the floor joist 14, the board pusher assembly 28 is positioned against the side of a floor board 16. This is done by sliding the handle connecting element 40 along the lever arm portion 22 of the handle assembly until the ram assembly 32 of the board pusher assembly 28 has a side placed against the floor board 16. As shown in FIG. 1, the ram assembly 32 has an L-shaped cross section so that a portion of the ram assembly 32 rests against the side of the floor board 16, and portion of the ram assembly 32 rests against the top of the floor board 16. In this way, the top of the floor board 16 serves to prevent the pushing side of the ram assembly 32 from falling out of contact with the side of the floor board 16.

When the ram assembly 32 is placed against the floor board 16, the hand grip 24 is pulled or pushed toward the floor board 16 in the direction of the arrow 19. When this takes place, the ram assembly 32 applies force to push the tongue-in-groove connection between adjacent floor boards 16 into secure engagement. In addition, when the handle grip 24 is pushed toward the floor board 16, the clamping assembly 12 is also affected. More specifically, as the handle grip 24 is pushed toward the floor board 16, the pivoting portion 20 pushes the carrier assembly 48 in the opposite direction shown by arrow 63. The movement of the carrier assembly 48 is this direction is very slight. Yet as the movement takes place, the carrier assembly 48 pulls the first hinge pin 58 also in the direction of the arrow 63. In so doing, the links 54 and 56 are pulled toward each other. As a result the first support bracket 52 and the second support bracket 53 are also pulled toward one another. In this case, the jaw assemblies 44 are also pulled toward each other causing the roughened inner walls 62 to dig into the floor joint 14. By the jaw assemblies 44 being pulled toward the floor joist 14, and by there being a secure and stable clamping of the jaw assemblies 44 against the floor joist 14, a large pushing force can be exerted by the ram assembly 32 against the floor board 16 without the clamping assembly 12 slipping on the floor joist 14.

After the floor board 16 is properly installed, the handle grip 24 is pushed in the opposite direction of arrow 19. As a result, the ram assembly 32 is pulled away from the floor board 16. In addition, the clamping assembly 12 is pushed in an opposite direction to arrow 63. As such, the links 54 and 56 are spread apart causing the first support bracket 52 and second support bracket 53 to spread apart causing the jaw assemblies 44 to release their grip on the floor joist 14. Once their grip is released, the clamping assembly 12 can be slid further along on the floor joist. Then, a new floor board 16 is put into place, and the force on the handle grip 24 is reversed again, to be in the direction of arrow 19, whereby the pushing action of the ram assembly 32 takes place again. By a repetitive oscillating action of pushing and pulling the hand grip 24 of the handle assembly 18 and by sliding the clamping assembly 12 along the floor joist, the flooring installation apparatus 10 of the invention alternates between pushing the tongue-in-groove floor boards 16 into position and sliding the clamping assembly 12 along the floor joist 14 incrementally. The overall action is like that of an inch worm.

Figure 5:
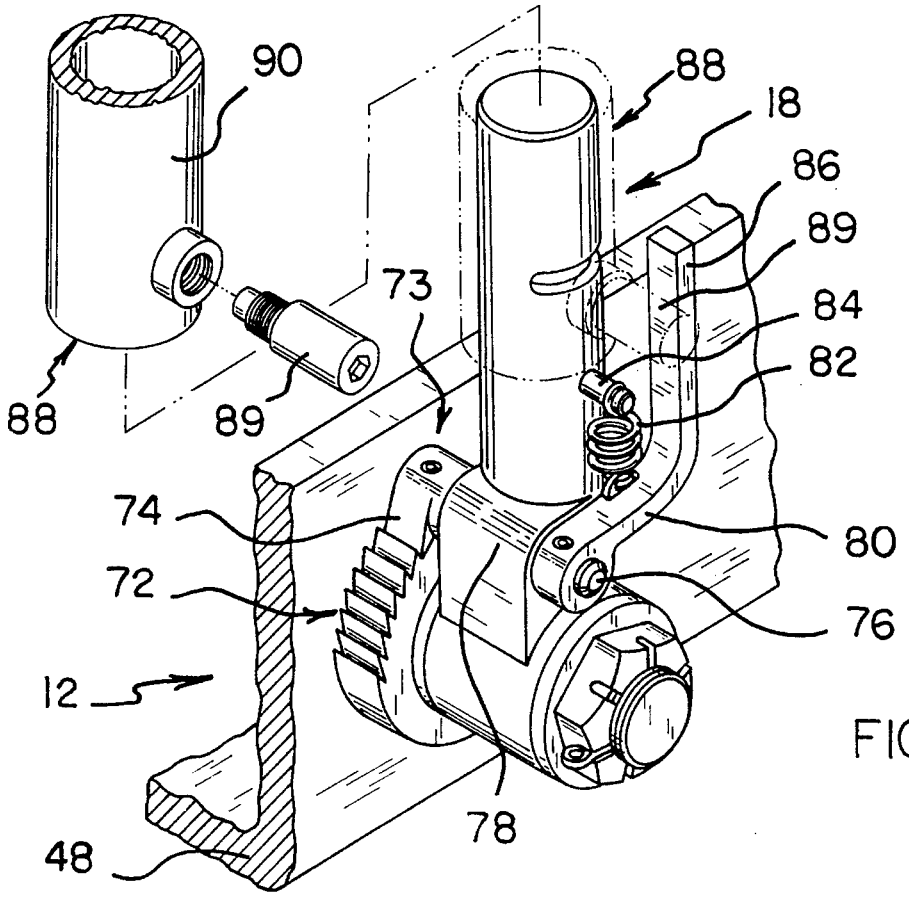
FIG. 5 is a partially exploded, partial perspective view of a second embodiment of the flooring installation apparatus of the invention wherein a ratchet mechanism is provided for sustaining an applied force onto the side of a floor board.

Turning to FIG. 5, a second embodiment of the invention is shown. Reference numerals are shown that correspond to like reference numerals that designate like elements shown in the other figures. In addition, a ratcheting assembly 70 locks the handle assembly 18 into a force-exerting position when the lever arm portion 22 is pushing against the board pusher assembly 28. The ratcheting assembly 70 includes a ratchet teeth assembly 72 rigidly attached to the clamping assembly 12. A pivoted pawl assembly 73 is connected to the handle assembly 18, such that, when the pivoted pawl assembly 73 engages the ratchet teeth assembly 72, the handle assembly 18 is locked into a force-exerting position for exerting a force on the board pusher assembly 28.

The pivoted pawl assembly 73 includes a pawl element 74 for directly engaging ratchet teeth of the ratchet teeth assembly 72. A shaft 76 is connected to the pawl element 74. A housing 78 received the shaft 76. The housing 78 is supported by the handle assembly 18, and a shaft biasing assembly is connected to the shaft 76 for biasing the shaft 76 such that the pawl element 74 normally engages teeth of the ratchet teeth assembly 72.

The shaft biasing assembly includes a lever element 80 connected to the shaft 76. A spring 82 is connected to the lever element 80. A spring support element 84 is connected to the handle assembly 18, for biasing the spring 82 with respect to the lever element 80 such that the shaft 76 is biased and causes the shaft 76 to urge the pawl element 74 into engagement with the ratchet teeth of the ratchet teeth assembly 72.

A disengaging assembly is provided for disengaging the pawl assembly 73 from the ratchet teeth assembly 72. The disengaging assembly includes a trip lever 86 connected to the lever element 80. A selectable actuator assembly 88 is connected to the handle assembly 18, for selectively actuating the trip lever 86. The selectable actuator assembly 88 includes an actuator element 89 for actuating the trip lever 86, and a handle sleeve 90 which fits over the lever arm portion 22 of the handle assembly 18. The handle sleeve 90 is rotatable on the lever arm portion 22. The lever arm portion 22 supports the actuator element 89.

In operation, when the actuator element 89 is positioned on the handle assembly 18 in an orientation so as to prevent contact with the trip lever 86, the spring 82 causes the pawl element 74 to engage the teeth of the ratchet teeth assembly. However, when the handle sleeve 90 is properly rotated around the longitudinal axis of the lever arm portion 22, the actuator element 89 is caused to push against and move the trip lever 86 so that the trip lever 86 moves the lever element 80 to move the shaft 76 to raise the pawl element 74 off of the teeth of the ratchet assembly 72 and permit the handle element 18 to be relieved of exerting pressure on the ram assembly 32.

Turning to FIGS. 6–7, a third embodiment of the invention is shown. Reference numerals are shown that correspond to like reference numerals that designate like elements shown in the other figures. In addition, a mechanized nail driving machine 91 is provided. A support assembly 92 attaches the mechanized nail driving machine 91 to the ram member 32. The support assembly 92 includes a support bracket 93 and a hinge 95 connecting the support bracket 93 to the ram member 32. Nailing machine actuator 94 is attached to the lever arm portion 22 in the vicinity of the handle grip 24.

In using the nail driving machine 91, the floor board 16 is first rammed into position by the ram member 32 under the control of the handle assembly 18. With the ratchet assembly in use, the board is fixed into proper position by a constant force exerted by the ram member 32. Then, the nail driving machine 91 is actuated causing a nail to be driven into a properly positioned floor board 16. The ratchet assembly and the nail driving machine permit one person to perform the multiple tasks of positioning the floor board 16 and then nailing it and fixing it into position.

The components of the flooring installation apparatus of the invention can be made from inexpensive and durable metal materials.

It is apparent from the above that the present invention accomplishes all of the objects set forth by providing a new and improved flooring installation apparatus that is low in cost, relatively simple in design and operation, and which may advantageously be used to permit proper installation of tongue-in-groove floor boards without hammering. With the invention, a flooring installation apparatus is provided which applies an installation force over a relatively large surface area to avoid damaging the floor boards during installation. With the invention, a flooring installation apparatus is provided which does not rely upon a rapidly moving, hard to control element for exerting force against a floor board for installation into an adjacent floor board. With the invention, a flooring installation apparatus is provided which employs levers for installing tongue-in-groove floor boards. With the invention, a flooring installation apparatus is provided which does not apply large amounts of kinetic energy to floor boards that can cause damage to the floor boards. With the invention, a flooring installation apparatus is provided which applies a slowly building force to the floor board rather than a sharp blow. With the invention, a flooring installation apparatus is provided which sustains and continuously applies a built-up force on a tongue-in-groove floor board for a period of time rather than dissipate a force immediately as occurs with a hammer blow. With the invention, a flooring installation apparatus is provided which is easily removed from one floor board to be applied to the next floor board needing installation. With the invention, a flooring installation apparatus is provided which includes a mechanized device for nailing the floor board into position on the floor once the tongue-in-groove installation has been made. With the invention, a flooring installation apparatus is provided which employs a simple lever for installing a tongue-in-groove floor board.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed and desired to be claimed by LETTERS PATENT of the United States is as follows:

1. A flooring installation apparatus for use with a rigid structure having opposed top and bottom edges with a floor board residing on said top edge of said rigid structure, the apparatus comprising:

a clamping assembly for clamping onto said rigid structure below a floor board to be installed, carrier means for supporting said clamping assembly proximal to said rigid structure in a confronting manner to said bottom edge of said rigid member, a handle assembly pivotally attached to said carrier means, said handle assembly including a pivoting portion for pivotally attaching to said carrier means, said handle assembly including a lever arm portion connected to said pivoting portion, said handle assembly including a handle grip connected to said lever arm portion, and a board pusher assembly connected to said lever arm portion of said handle assembly, such that, when said clamping assembly is clamped onto said rigid structure with said carrier means confronting the bottom edge of said rigid member, and when a force is exerted on said handle grip in a direction toward a floor board, said board pusher assembly is capable of pushing against the floor board.

2. The apparatus described in claim 1 wherein said board pusher assembly includes:

a ram assembly, and a connector assembly, connected to said ram assembly, for connecting said board pusher assembly to said handle assembly.

3. The apparatus described in claim 2 wherein said connector assembly includes:

a first pivoted joint element connected to said ram assembly, and a second pivoted joint element for connecting to said first pivoted joint element, said second pivoted joint element located on a handle connecting element connected to said handle assembly.

4. The apparatus described in claim 3 wherein said handle connecting element of said connector assembly is capable of being adjusted along a length of said lever arm portion of said handle assembly.

5. The apparatus described in claim 4 wherein said handle connecting element is in the form of a sleeve that is capable of sliding up and down said lever arm portion.

6. The apparatus described in claim 1, further including:

a stop element, located on said lever arm portion, for limiting longitudinal motion of said connector assembly along said lever arm portion.

7. The apparatus described in claim 1 wherein said clamping assembly includes:

a pair of jaw assemblies, spring-biased assemblies connected to said jaw assemblies and capable of urging said jaw assemblies apart to be retracted away from the rigid structure, and a carrier assembly connected to said spring-biased assemblies, said carrier assembly also including a pivot post for connection to said handle assembly, wherein by control executed through said handle assembly, through said carrier assembly, and through said spring-biased assemblies, said pair of jaw assemblies is capable of being selectively clamped onto the rigid structure for exerting a clamping force thereon or capable of being retracted from the rigid structure, respective clamping force and respective retracting force of said jaw assemblies being controlled by operation of said handle assembly.

8. The apparatus described in claim 7 wherein said jaw assemblies include:

clamping pad elements, and respective clamping pad support brackets for receiving and supporting said clamping pad elements, wherein said clamping pad elements include tabs that engage complementary slots in said respective clamping pad support brackets.

9. The apparatus described in claim 8 wherein said respective clamping pad support brackets are supported by said spring-biased assemblies.

10. The apparatus described in claim 9 wherein said respective spring-biased assemblies include:

a first link element and a second link element, said first and second link elements pivotally connected together at respective first ends to a first hinge pin which is connected to said carrier assembly at a receiving aperture, a second end of said first link element connected to a first support bracket by a second hinge pin, a second end of said second link element connected to a second support bracket-by a third hinge pin.

11. The apparatus described in claim 8 wherein said clamping pad elements include an upper chamfered edge.

12. The apparatus described in claim 8 wherein said clamping pad elements include roughened inner walls which permit said clamping pad elements to bite into sides of the rigid structure.

13. The apparatus described in claim 1, further including:

a ratcheting assembly for locking said handle assembly into a force-exerting position when said lever arm portion is pushing against said board pusher assembly.

14. The apparatus described in claim 13 wherein said ratcheting assembly includes:

a ratchet teeth assembly rigidly attached to said clamping assembly, and a pivoted pawl assembly connected to said handle assembly, such that, when said pivoted pawl assembly engages said ratchet teeth assembly, said handle assembly is locked into a force-exerting position for exerting a force on said board pusher assembly.

15. The apparatus described in claim 14 wherein said pivoted pawl assembly includes:

a pawl element for directly engaging ratchet teeth of said ratchet teeth assembly, a shaft connected to said pawl element, a housing for receiving said shaft, said housing supported by said handle assembly, and a shaft biasing assembly connected to said shaft for biasing said shaft such that said pawl element engages teeth of said ratchet teeth assembly.

16. The apparatus described in claim 15 wherein said shaft biasing assembly includes:

a lever element connected to said shaft, a spring connected to said lever element, a spring support element, connected to said handle assembly, for biasing said spring with respect to said lever element such that said shaft is biased and causes said shaft to urge said pawl element into engagement with said ratchet teeth of said ratchet teeth assembly.

17. The apparatus described in claim 14, further including:

a disengaging assembly for disengaging said pawl assembly from said ratchet teeth assembly.

18. The apparatus described in claim 17 wherein said disengaging assembly includes:

a trip lever connected to said lever element, and a selectable actuator assembly, connected to said handle assembly, for selectively actuating said trip lever.

19. A flooring installation apparatus comprising:

a clamping assembly for clamping onto a rigid structure below a floor board to be installed;

a handle assembly pivotally attached to said clamping assembly;

a board pusher assembly connected to said handle assembly for engaging a floor board during pivoting of the handle assembly towards said floor board, said board pusher assembly including a ram assembly and a connector assembly coupled to said ram assembly for connecting said board pusher assembly to said handle assembly.

20. A flooring installation apparatus comprising:

a clamping assembly for clamping onto a rigid structure below a floor board to be installed, said clamping assembly comprising a pair of jaw assemblies, spring biased assemblies connected to said jaw assemblies and capable of urging said jaw assemblies apart to be retracted from said rigid structure;

a handle assembly pivotally attached to said clamping assembly;

a board pusher assembly connected to said handle assembly for engaging a floor board during pivoting of the handle assembly towards said floor board.

* * * * *